United States Patent [19]

Hayashi

[11] 4,047,404

[45] Sept. 13, 1977

[54] PRINTED FABRIC WASHING APPARATUS

[75] Inventor: Takashi Hayashi, Kyoto, Japan

[73] Assignee: Tanno Senshoku Kogyo Co., Ltd., Kyoto, Japan

[21] Appl. No.: 742,616

[22] Filed: Nov. 17, 1976

[51] Int. Cl.[2] ..... D06B 3/20

[52] U.S. Cl. ..... 68/152; 68/178

[58] Field of Search ..... 68/53, 148, 152–156, 68/172, 177, 178, 179

[56] References Cited

U.S. PATENT DOCUMENTS

| | | | |
|---|---|---|---|
| 2,826,057 | 3/1958 | Olson | 68/153 X |
| 3,626,449 | 12/1971 | Arashi | 68/158 |
| 3,631,692 | 1/1972 | Garzotto | 68/152 X |
| 3,821,883 | 7/1974 | Horie et al. | 68/153 X |
| 3,901,055 | 8/1975 | Broadbent | 68/152 |
| 3,949,579 | 4/1976 | Bertoldi | 68/152 |
| 3,950,968 | 4/1976 | Dalla Vecchia | 68/53 |

*Primary Examiner*—Philip R. Coe

*Attorney, Agent, or Firm*—Darby & Darby

[57] ABSTRACT

A printed fabric washing apparatus comprises a U-shaped tunnel-like cage, a tank in which the cage is disposed for vertical movement and a ridge-like projection mounted on the bottom transversely below the cage, a fabric introduced in the cage being washed and travelled in a tensionless condition by the water repelled at the ridge-like projection as a result of the up and down movement of the cage.

1 Claim, 3 Drawing Figures

PRINTED FABRIC WASHING APPARATUS

BACKGROUND OF THE INVENTION

The present invention relates to improvements in a printed fabric washing apparatus. More particularly, it relates to a printed fabric washing apparatus capable of efficiently washing a printed fabric in a tensionless condition while moving the same.

In conventional printed fabric washing apparatuses, a printed fabric is received in an inner case and the case or the outer washing chamber is oscillated back and forth or semi-circularly rotated, but they are low in washing efficiency and tend to produce unevenness of washing.

An object of the present invention is to provide an improved printed fabric washing apparatus eliminating these drawbacks.

Another object of the invention is to provide a printed fabric washing apparatus capable of efficiently washing a fabric in a tensionless condition while moving the same.

It is also an object of the invention to provide a printed fabric washing apparatus capable of efficiently washing a fabric by making use of water resistance and repulsion.

SUMMARY OF THE INVENTION

A printed fabric washing apparatus according to the invention comprises a U-shaped tunnel-like cage of rectangular cross-section formed of a sheet of net, and a tank in which said cage is disposed with its middle linear portion lying below and with its upwardly curving vertical portions at opposite ends providing printed fabric introducing and withdrawing ports, respectively, so as to allow the up and down movement of said cage within said tank, a ridge-like projection mounted centrally transversely on the bottom of said tank and below said cage with its angle top lying at right angles with the axis of said linear portion of said cage, coupling rods attached to the opposed inner sides of said vertical portions of the cage and extending horizontally and parallelly with the axis of said linear portion, U-shaped suspension frames each fixed to one of said coupling rods at the middle and having a loose pulley attached thereto, a rotatable shaft installed on posts and extending over said tank above the middle of opposite lateral walls of the tank and at right angles with the axis of said linear portion of the cage, and an eccentric wheel fixed on said rotatable shaft and carrying thereon said loose pulley to suspend said cage. The rotatable shaft is operatively associated with the rotation of a motor to rotate the eccentric wheel so that the cage is moved up and down in the tank.

DETAILED DESCRIPTION OF PREFERRED EMBODIMENT

Figure 1:
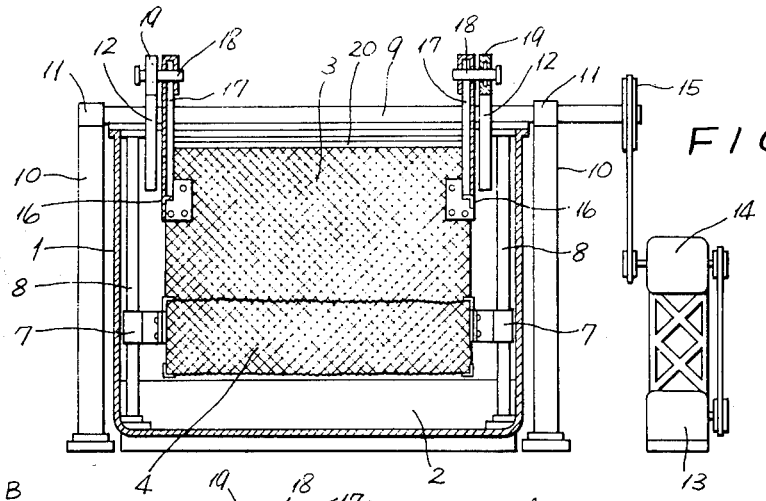
FIG. 1 is a longitudinal section of a printed fabric washing apparatus according to the invention.
Figure 2:
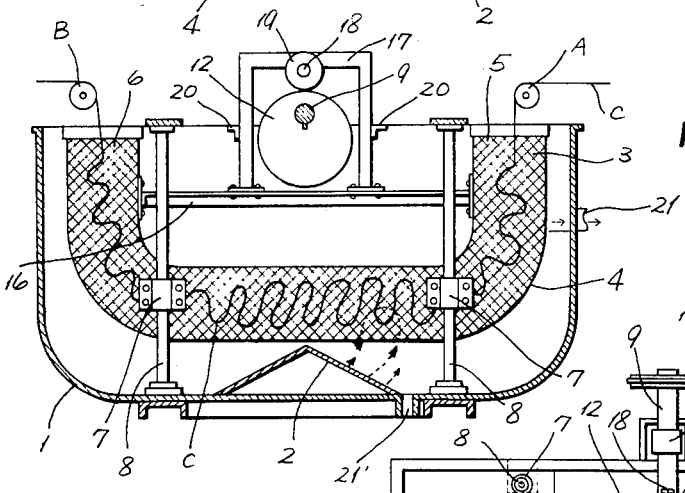
FIG. 2 is a side view showing the printed fabric washing apparatus of FIG. 1 in operation with a tank shown broken away.
Figure 3:
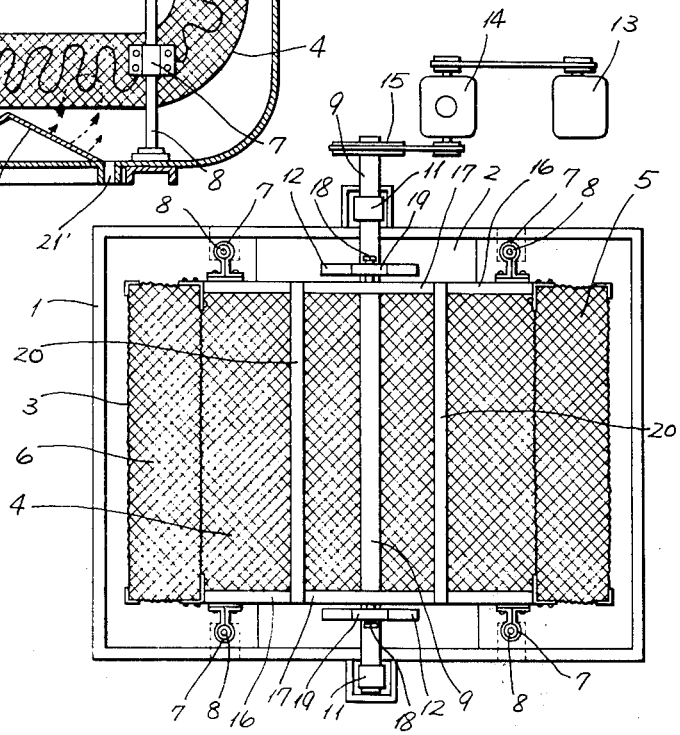
FIG. 3 is a plan view of the printed fabric washing apparatus of FIG. 1.

According to the invention, a cage 4 immersed in washing water in a tank 1 is centrally provided with a linear portion while a ridge-like projection 2 is provided on the bottom of the tank transversely below said linear portion, said cage 4, in which a fabric C to be washed is received, being moved up and down. The fabric C is subjected to a "rubbing action" produced by water resistance and to a "beating action" produced by the repulsion of water dashing againt the ridge-like projection 2 when the cage is downwardly moving, so that the washing efficiency is very high. The repulsion of water by the ridge-like projection 2 acts to convey the fabric C in a tensionless condition.

Preferably, the transverse section of the tank 1 is rectangular, relatively long in the direction of travel of the fabric.

The cage 4 disposed in the tank 1 is a tunnel-like cage of rectangular cross-section formed of a wire or synthetic resinous screen 3, having a linear portion in the middle with its opposite ends curved and extending upwardly, one of the tunnel-like opposite end openings being a fabric introducing port 5 and the other being a fabric withdrawing port 6.

Coupling rods, 16, 16 connecting the opposed sides of the opposed vertical portions of the cage 4 have U-shaped suspension frames 17, 17 erected thereon in their middle regions, and loose pulleys 19, 19 are installed on fixed shafts 18, 18 projecting from said U-shaped suspension frames 17, 17.

A rotatable shaft 9 installed on posts 10, 10 and extending over the middle regions of opposite lateral walls of the water tank 1 has eccentric wheels 12, 12 fixed thereon so as to be opposed to said loose pulleys 19, 19.

Thus, the loose pulleys 19, 19 projecting from the U-shaped suspension frames 17, 17 are carried on the eccentric wheels 12, 12 to suspend the cage 4.

A ridge-like projection 2 is provided on the bottom of the tank 1 transversely below the linear portion of the cage 4.

Slide tubes 7 project from the cage 4 in the front and rear regions on both sides thereof, and they are fitted on four guide posts 8 erected inside the tank 1 to guide the cage 4 as the latter is moved up and down in a vertical line.

The rotation of a motor 13 is transmitted through a speed reducing mechanism 14 to a pulley 15 on the rotatable shaft 9, whereby the eccentric wheel 13 fixed on the rotatable shaft 9 is rotated to produce up and down movement of the cage 4 within the tank 1.

Washing water is contained in the tank 1 to the level of an overflow port 21 and the fabric C to be washed entrained around an introducing roll A is passed through the introducing port 5 into the cage 4 and gradually washed until it is taken out through the withdrawing port 6 and entrained around a withdrawing roll B. Thus, the fabric C contained in the cage 4 is subjected to a beating action in the horizontal portion produced by the up and down movement of the cage 4 in the water and to a rubbing action in the upwardly extending curved portions at the opposite ends of the cage. Further, the circulating flow of water produced by the ridge-like projection 2 on the bottom of the tank when the cage 4 is pulled up doubles the action of beating the fabric when the cage 4 is lowered.

Another feature of the invention is that the water repelled at the ridge-like projection 2 upon striking the latter as a result of the up and down movement of the cage 4 causes the travel of the fabric C without a tension. Thus, the invention is very useful as a printed fabric washing apparatus. In addition, the cage is moved up and down 100–250 times per minute.

What I claim is:

1. A printed fabric washing apparatus comprising a U-shaped tunnel-like cage of rectangular cross-section formed of a screen material, said cage having a middle linear portion and upwardly curving vertical portions positioned at opposite ends of said middle linear portion to define the U-shape, a liquid containing tank in which said cage is disposed with said middle linear portion lying below said liquid and with its upwardly curving vertical portions located at opposite ends of said tank and providing introducing and withdrawing ports for, respectively, introducing and withdrawing a printed fabric to and from said cage, a ridge-like projection mounted centrally on the bottom of said tank transversely below said linear portion of said cage, coupling rods attached to the opposed inner sides of said vertical portions of the cage and extending horizontally with the longitudinal axis of said linear portion, U-shaped suspension frames each fixed to one of said coupling rods at the middle of the respective rod, each frame having a loose pulley attached thereto, a rotatable shaft installed on posts and extending over said tank above the middle of opposite lateral walls of the tank and at right angles with the longitudinal axis of said linear portion of the cage, and eccentric wheels fixed on said rotatable shaft with each wheel carrying thereon a respective loose pulley to suspend the cage, a motor operatively associated with said rotatable shaft to rotate the shaft and eccentric wheels such that the rotation of the eccentric wheels causes said cage to move up and down within the tank.

* * * * *